United States Patent [19]

Poturnicki, Jr. et al.

[11] Patent Number: 4,782,470

[45] Date of Patent: Nov. 1, 1988

[54] HYDROPHONE WITH EXTENDED OPERATIONAL LIFE

[75] Inventors: Alfred S. Poturnicki, Jr., Duxbury; James E. Traft, Quincy, both of Mass.

[73] Assignee: General Instrument Corp., New York, N.Y.

[21] Appl. No.: 934,002

[22] Filed: Nov. 24, 1986

Related U.S. Application Data

[60] Division of Ser. No. 797,190, Nov. 13, 1985, which is a continuation of Ser. No. 603,990, Apr. 25, 1984, abandoned, which is a continuation of Ser. No. 298,098, Aug. 31, 1981, abandoned.

[51] Int. Cl.[4] ..... H04R 17/00

[52] U.S. Cl. ..... 367/157; 367/159; 310/337; 29/25.35; 29/594; 264/272.16

[58] Field of Search ..... 367/152, 155, 157, 154, 367/159, 188; 310/337, 340, 338, 339; 29/25.35, 594; 264/24, 135, 265, 272.16; 174/101.5, 52 PE; 181/122

[56] References Cited

U.S. PATENT DOCUMENTS

| | | | |
|---|---|---|---|
| 2,769,930 | 11/1956 | Sturm | 310/340 |
| 3,027,540 | 3/1962 | Howatt | 367/159 |
| 3,070,775 | 12/1962 | Andrews, Jr. | 310/340 |
| 3,142,035 | 7/1964 | Harris | 367/155 |
| 3,144,090 | 8/1964 | Mazzagatti et al. | 367/155 |
| 3,167,668 | 1/1965 | Nesh | 310/340 |
| 3,255,431 | 6/1966 | Howatt | 367/155 X |
| 3,277,451 | 10/1966 | Parssinen | 367/155 |
| 3,353,150 | 11/1967 | Jacox | 367/155 |
| 3,458,857 | 7/1969 | Hancks et al. | 367/155 |
| 3,930,061 | 12/1975 | Scharfenberger | 264/24 X |
| 3,979,565 | 9/1976 | McShane | 367/157 X |
| 4,051,396 | 9/1977 | Berlincourt | 310/340 X |
| 4,110,727 | 8/1978 | Kriege | 367/157 |
| 4,230,754 | 10/1980 | Maher et al. | 264/135 X |
| 4,700,333 | 10/1987 | Massa et al. | 367/157 |

OTHER PUBLICATIONS

"The Condensed Chemical Dictionary 8th Edition", Van Nostrand Reinhold Co., N.Y., N.Y., 1971, p. 350.

*Primary Examiner*—Deborah L. Kyle
*Assistant Examiner*—Brian S. Steinberger
*Attorney, Agent, or Firm*—James & Franklin

[57] ABSTRACT

Permeation of sea water through the protective rubber housing to the conductive portions of the exterior surface of the ceramic or other pressure-sensitive element results in the development of a low insulation resistance which leads to failure of the unit. The operational life of the unit is extended through the application of an acoustically transparent water impervious layer, interposed and bonded between the exterior surface of the ceramic or other pressure-sensitive element and the interior surface of the rubber housing.

10 Claims, 1 Drawing Sheet

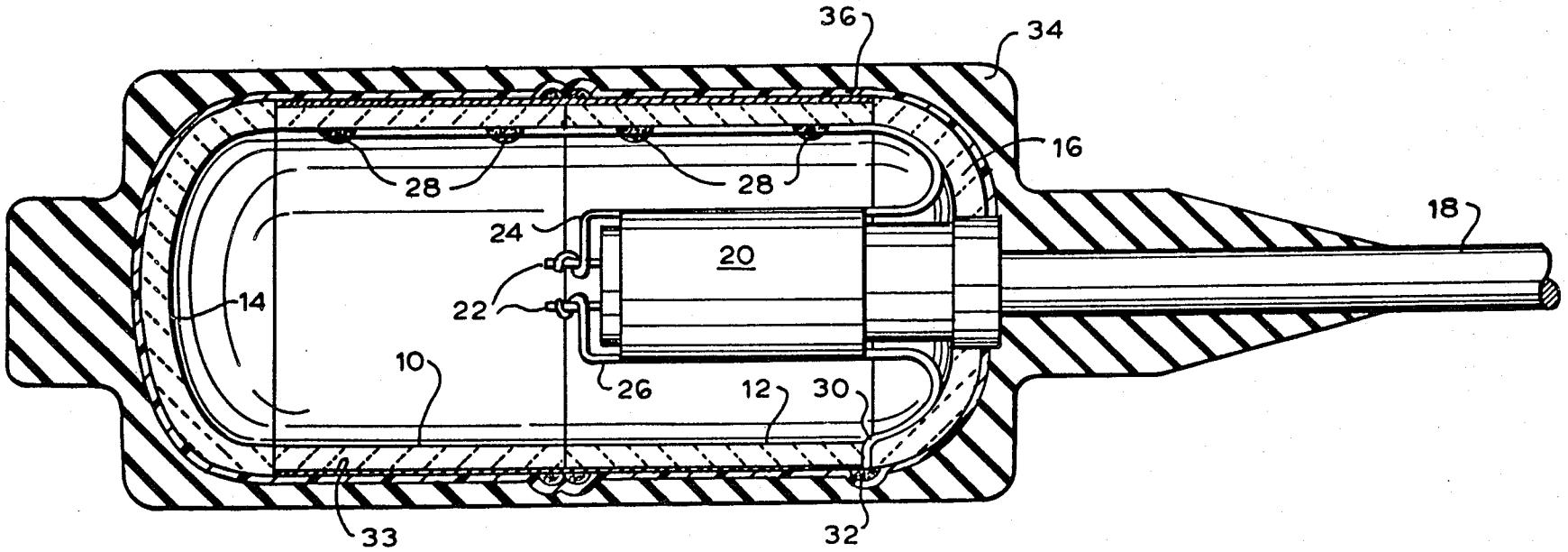
18
34
16
36
28
28
20
24
22
26
30
12
10
14
32
33

HYDROPHONE WITH EXTENDED OPERATIONAL LIFE

This is a divisional of prior U.S. application Ser. No. 797,190 filed Nov. 13, 1985 which, in turn, was a continuation of prior U.S. application Ser. No. 603,990 filed Apr. 25, 1984 now abandoned which, in turn, was a continuation of prior U.S. application Ser. No. 298,098 filed Aug. 31, 1981 now abandoned.

The present invention relates to underwater acoustic transducers and hydrophones and, more particularly, to a hydrophone which includes an acoustically transparent water impervious layer which prevents sea water permeation so as to extend the operational life of the device.

A hydrophone is, as the name implies, a device designed to be immersed in water and to there function as a transducer between pressure variations (sound) and electrical signals, either detecting pressure variations and converting them to electrical signals or detecting electrical signals and converting them to pressure variations. Hence the hydrophone, generally speaking, comprises an appropriate transducer to which electrical connections are made, and the transducer and electrical connections are encased within an acoustically transparent housing or "boot". The transducers generally comprise either nickel or certain ceramic substances. One general type of conventional hydrophone, in connection with which the present invention is here specifically illustrated for purpose of example, comprises a pair of coaxial, hollow piezoelectric ceramic cylinders with caps at either end which, when assembled, forms an enclosure which has partially silvered, or electroless nickeled inner and outer surfaces. The partially silvered, or electroless nickeled inner and outer surfaces are respectively connected to leads which are attached to terminals on the internal portion of a plug which extends through one of the end caps. The terminals are, in turn, connected to a cable which extends from the enclosure. Molded about and bonded to the exterior surface of the enclosure is an acoustically transparent rubber housing or "boot", the function of which is to protect the enclosure, its silvered or electroless nickeled surfaces and the electrical connections thereto from sea water.

Such devices are designed for continuous exposure to sea water for extended periods. In the event that sea water permeates through the outer rubber housing, the device develops a low insulation resistance and eventually an electrical short. Thus, the normal operational life for the unit is reduced. The typical operational life of a unit is dependent upon the type and construction, as well as the thickness and composition, of the rubber housing and the manner of installation thereof, but is typically on the order of three to five years.

After analysis of a number of failed units, it was determined that the failure of the units was a direct result of water permeation through the rubber housing, which resulted in contact of sea water with the partially silvered surfaces of the ceramic enclosure and/or the electrical connections, thereby giving rise to an unacceptably low value of insulation resistance. One possible solution to this problem was to enhance the protective qualities of the rubber housing. However, after some investigation, it was found that the state of the art in rubber compounding technology was insufficient to further improve the quality and durability of the rubber housing.

Many of the hydrophones produced are manufactured for use by the armed services and, particularly, the United States Navy. The Navy specifications require that the hydrophone have a specific set of outside dimensions. It was therefore necessary to improve the operational life of the hydrophone without altering the outside dimensions thereof, such that the improved units would still be in accordance with Navy specifications and, thus, could be readily used as replacement units by the Navy.

It is, therefore, a prime object of the present invention to provide a hydrophone with an extended operational life.

It is another object of the present invention to provide a hydrophone with extended operational life through the use of a water barrier which is substantially acoustically transparent.

It is another object of the present invention to provide a hydrophone with extended operational life without alteration of the outside dimensions thereof.

It is another object of the present invention to provide a hydrophone with extended operational life wherein the water barrier comprises a water impervious layer which is chemically compatible with the materials used to form the other parts of the unit, and which can be applied without adversely affecting the polarity of the unit.

It is another object of the present invention to provide a hydrophone with extended operational life wherein the water barrier is composed of materials capable of achieving the necessary bonds with the surface of the ceramic enclosure and the rubber housing.

It is another object of the present invention to provide a hydrophone with extended operational life wherein the water impervious layer will provide complete coverage on the conductive portions of the exterior surface of the ceramic enclosure.

It is another object of the present invention to provide a hydrophone with extended operational life wherein the water impervious layer is composed of a material with an appropriately high insulation resistance, usually at least 250 megohms at 500 volts, and preferably a higher resistance such as approximately 1,000 megohms at 500 volts.

It is another object of the present invention to provide a hydrophone with extended operational life wherein the water impervious layer is durable enough to withstand mechanical abuse.

It is another object of the present invention to provide a hydrophone with extended operational life wherein the water impervious layer is curable at a temperature below the temperature at which the ceramic enclosure loses its polarity.

In accordance with the present invention, a hydrophone is provided comprising a piezoelectric enclosure, here shown as of the ceramic type, with an exterior surface having a conductive portion to which electrical connection is made. A substantially acoustically transparent rubber housing surrounds the enclosure. A substantially acoustically transparent water impervious layer is interposed and bonded between the exterior surface of the enclosure and the interior surface of the rubber housing. The water impervious layer prevents permeation of sea water to the conductive surface portions of the ceramic enclosure and the electrical connections thereto. In this manner, a low insulation resistance, which may eventually develop into an electrical short, is prevented.

The layer is composed of a material having an insulation resistance of at least approximately 250 megohms at 500 volts and, preferably, approximately 1,000 megohms at 500 volts. The material bonds with the exterior surface of the enclosure, particularly the conductive portion thereof, and to the rubber of the housing.

The material is preferably applied to the unit by coating the exterior surface of the enclosure with a layer. The layer is then cured by heating to a temperature of not more than 425° F. and, preferably, approximately 300° F. Curing takes place at a relatively low temperature such that the heat will not cause the enclosure to depole. Due to the lower than normal curing temperature, an extended curing period of approximately thirty minutes may be required.

By proper selection of materials and application techniques, a water impervious layer can be achieved which will insure maximum resistance to abrasion, chemical attack and mechanical damage and, at the same time, be chemically compatible with the materials forming the other portions of the unit.

To these and such other objects which may hereinafter appear, the present invention relates to a hydrophone with extended operational life, as described in the following specification and recited in the annexed claims, taken together with the accompanying drawing, which shows a side cross-sectional view of the hydrophone of the present invention.

As illustrated in the drawing, the specific embodiment of the hydrophone of the present invention which is here shown consists of a pair of hollow piezoelectric ceramic cylinders 10, 12 approximately 2½ inches in diameter by 2 inches high, with a wall thickness of 3/16 of an inch. Cylinders 10 and 12 are coaxially aligned and fastened together, by an epoxy or the like. A first ceramic end cap 14 is affixed, by means of an epoxy or the like, to the unattached end of cylinder 10. A second ceramic end cap 16 is affixed, by means of an epoxy or the like, to the unattached end of cylinder 12. In this manner, an elongated hollow ceramic enclosure is formed.

Cap 16 is provided with a central opening through which a two conductor cable 18 extends. Cable 18 is connected to a plug 20, affixed to the interior of cap 16, which has terminals 22 thereon. Leads 24, 26 are soldered to the respective terminals 22. Lead 24 is electrically connected at points 28 to a thin conductive layer, usually about 0.003 of an inch thick and, preferably, at least partially composed of silver or nickel, which partially covers the interior surface of the ceramic enclosure. Lead 26 extends through an opening 30 between cylinder 12 and end cap 16 to the exterior of the enclosure and is electrically connected at 32 to a similarly thin conductive layer, also preferably at least partially composed of silver or nickel, which partially covers the exterior surface of the enclosure. Because of the thinness of those conductive layers, they are not explicitly shown on the drawing.

The ceramic enclosure, with its partially silvered exterior and interior surfaces, is enclosed within a rubber housing or "boot" 34, preferably composed of polychloroprene, which is molded around and bonded to the enclosure to provide a water-tight seal. It has been found, however, that the polychloroprene housing tends to deteriorate, after from three to five years of exposure to sea water, such that the unit develops a low insulation resistance and possibly eventually an electrical short which reduces the useful life of the device.

The hydrophone described above is a conventional hydrophone assembly which has been produced since 1976 by the Government Systems Division of General Instrument Corporation for use by the United States Navy as part number DT-276.

In accordance with the present invention, interposed and bonded between the exterior surface of the ceramic enclosure and the interior surface of the rubber housing 34 is a substantially acoustically transparent water impervious layer 36 which is capable of preventing sea water permeation to the silvered surfaces of the enclosure and the electrical connections thereto, even after the sea water may have penetrated the rubber housing 34.

The water impervious layer 36 is quite thin and therefore does not alter the outside dimension of the hydrophone assembly to any appreciable extent. In addition to being substantially acoustically transparent, the layer has to be chemically compatible with the materials which make up the other portions of the unit. Moreover, the layer must have high insulation resistance, at least approximately 250 megohms at 500 volts and, preferably, as high as 1,000 megohms at 500 volts in water.

When applied to the surface of the enclosure, with its partial silver coating, the adherence of the layer thereto must be equal to or greater than that of the polychloroprene rubber coating itself, and the applied coverage must be 100% on the conductive silvered portions and the electrical connections thereto. Moreover, the material must bond with polychloroprene and be durable enough to withstand mechanical abuse.

One material which meets all of the above criteria is an epoxy powder made up of bisphenol epichlorohydrin epoxy, the main resin, barium sulfate, titanium dioxide and moda flow, which is the primary flow agent. This material is commercially available under the tradename Farbond Epoxy and is produced by the Farboil Company.

The epoxy powder may be applied by an electrostatic process. During the electrostatic application process, a positive charge is imposed upon the air driven powder as it passes through a gun head. The positively charged powder particles are attracted to the negatively charged or grounded ceramic enclosure. The electrical charge holds the powder in place during transport to an oven and through the complete bake cycle. The powder is electrostatically sprayed to insure a uniform coating which, after curing, will have maximum resistance to abrasion, chemical attack, and mechanical damage.

The application process must be temperature controlled so that the heat does not cause the ceramic to depole. Thus, the application and the curing of the epoxy is performed at a temperature below 425° F. and, preferably, not above 300° F. Since the curing temperature is below normal, an extended period of time, preferably approximately thirty minutes, is generally required.

Other types of materials for the water impervious layer were considered. Most were discarded because they could not meet the critical temperature limitations. That is, they could not be cured below 425° F.—the temperature at which the ceramic loses its polarity. However, vinyl, nylon and powder epoxies, especially the phenolic epoxies, by nature have especially good corrosion-resistant and dielectric properties and are suitable for this application.

These substances can be applied in a number of different ways. Fluidized bed, powder and liquid spray, electrostatic spray and dip-coating can all be used to deposit a suitable uniform coating.

It will now be appreciated that the present invention relates to a hydrophone having an acoustically transparent, water impervious layer coated on the exterior surface of the ceramic enclosure in order to extend the operational life of the unit. The epoxy or other material used to form the water impervious layer is chosen not only for its acoustically transparent properties, but also because it is chemically compatible with the other materials used in the device and because it will create acceptable bonds with the ceramic, silver and rubber materials to which it adheres. Moreover, the layer provides a substantially uniform coating which has maximum resistance to abrasion, chemical attack and mechanical damage, as well as a high insulation resistance.

While only a single embodiment of the present invention has been described herein for purposes of illustration, it is obvious that many variations and modifications could be made thereto. It is intended to cover all of these variations and modifications which fall within the scope of the present invention, as defined by the following claims. It should also be appreciated that the present invention is utilizable in conjunction with a wide variety of different types of transducers, hydrophones and projectors, and that the particular hydrophone structure described herein should not be considered a limitation on the present invention.

We claim:

1. A method of fabricating a hydrophone comprising the steps of: forming a hollow piezoelectric ceramic enclosure with an exterior surface; coating the exterior surface of the enclosure with a thin, substantially uniform, acoustically transparent, water impervious epoxy layer; curing the epoxy layer by heating to a temperature less than the temperature at which the enclosure loses its polarity and molding a rubber housing around the enclosure, said housing being relatively thicker than said epoxy layer, the housing having an interior surface, the epoxy layer bonding substantially the entire exterior surface of the enclosure to said interior surface of the housing.

2. The method of claim 1, wherein said cure temperature of said layer is less than 425° F.

3. The method of claim 1, wherein the cure temperature of said layer is approximately 300° F.

4. The method of claim 1, wherein said layer is cured for approximately thirty minutes.

5. The method of claim 1, wherein said layer is composed of a phenolic epoxy.

6. The method of claim 1, wherein said layer comprises a Bisphenol epichlorohydrin epoxy.

7. The method of claim 1, wherein the step of coating comprises the step of electrostatically spraying.

8. The method of claim 1, wherein said layer is composed of a material having an insulating resistance of at least approximately 250 megohms at 500 volts.

9. The method of claim 8, wherein said layer is composed of a material having an insulating resistance of approximately 1,000 megohms at 500 volts.

10. The method of claim 1, wherein said exterior surface has a condutive portion and wherein said layer is composed of material which bonds to said conductive portion.

* * * * *